US007269861B1

(12) United States Patent
Miller

(10) Patent No.: US 7,269,861 B1
(45) Date of Patent: Sep. 18, 2007

(54) SPLASH PROTECTOR FOR SHOWER

(76) Inventor: Gerald Miller, 414 Monastery Pl., Union City, NJ (US) 07087

( * ) Notice: Subject to any disclaimer, the term of this patent is extended or adjusted under 35 U.S.C. 154(b) by 267 days.

(21) Appl. No.: 11/167,352

(22) Filed: Jun. 27, 2005

(51) Int. Cl.
*A47K 3/022* (2006.01)

(52) U.S. Cl. ..... 4/609

(58) Field of Classification Search ..... 4/557–558, 4/607–609, 658; D23/307
See application file for complete search history.

(56) References Cited

U.S. PATENT DOCUMENTS 1,709,545 A * 4/1929 Sheppard ..... 4/658
1,791,696 A 2/1931 Alexander
2,173,993 A * 9/1939 Amdur ..... 4/558
D273,609 S 4/1984 Huffington, Jr.
4,620,332 A 11/1986 Laird
4,765,001 A 8/1988 Smith
5,222,261 A * 6/1993 Tooze et al. ..... 4/608
5,365,619 A 11/1994 Solomon
5,381,564 A 1/1995 Carroll
5,606,752 A 3/1997 Shenton, Jr. et al.
5,732,419 A * 3/1998 Feist ..... 4/558
5,771,504 A * 6/1998 Steiner ..... 4/558
6,341,388 B1 1/2002 Roberts

* cited by examiner

*Primary Examiner*—Charles E. Phillips
(74) *Attorney, Agent, or Firm*—Lawrence J. Gibney, Jr.

(57) ABSTRACT

A device used to prevent water from exiting a shower or bathtub that consists of a guard, a curved channel, and a pair of hooks to rest onto the lip of a bathtub.

4 Claims, 3 Drawing Sheets

SPLASH PROTECTOR FOR SHOWER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the prevention of water exiting a bath tub. It further relates to a shield used to prevent water from exiting a bath tub.

B. Prior Art

Prior art exists, which relates to the prevention of water exiting a bath tub. However, the structure and method for doing so in the present invention is new and improved. The Laird (U.S. Pat. No. 4,620,332) patent consists of a channel mounted on the outside perimeter of a bath tub, which channels spilled water toward a container. The Alexander (U.S. Pat. No. 1,791,696) patent claims a shield mounted to the lip of a bath tub to prevent water from spilling onto the floor. The Solomon (U.S. Pat. No. 5,365,619) patent claims a splash guard attached to the lip of the bathtub and a shield, which attaches to the wall. The present invention combines a portable shield attached to the lip of the bathtub and a channel mounted inside the bathtub to channel water toward the drain.

BRIEF SUMMARY OF THE INVENTION

The present invention is a shield that is used to prevent water from exiting the shower stall or bathtub. When an individual is taking a shower, water will be prone to exit the shower space around the edges of the shower curtain, which is constructed from flexible material. If the shower curtain does not remain flat against the interior surfaces of the shower area, water will escape. Because shower curtains are not made from rigid material, shower curtains will not be prone to lay flat against the shower stall surfaces.

This device provides the needed rigidity to address this problem. It will consist of a substantially rigid plastic shield featuring an overflow channel, which is placed under the lower edge of the shower curtain to channel the water towards the interior of the bathtub or shower stall. The channel will redirect water towards the drain.

The present invention will be mounted so that the shield is located against the outside surface of a shower curtain, but still within the bathtub; the placement of the shield in this fashion will provide the needed rigidity A set of hooks on one side of the device will secure it to the bathtub. This device can be used with a bathtub that has a raised side and is designed to be portable.

It is an object of this device to prevent water from exiting a shower with a portable device that can be installed over the outer edge of a bathtub.

DRAWING REFERENCE NUMERALS

5 Shield
10 Hook
15 Shower Curtain
16 Water from shower
20 Bathtub
22 Ground
24 Water exiting channel
25 Overflow channel

DETAILED DESCRIPTION OF THE EMBODIMENTS

The present invention is a device to be used in conjunction with a shower to prevent water from escaping the confines of the bathtub. The escape of water occurs because shower curtains are made from flexible material and water is able to escape from the tub or shower area around the ends of the shower curtain.

Figure 1:
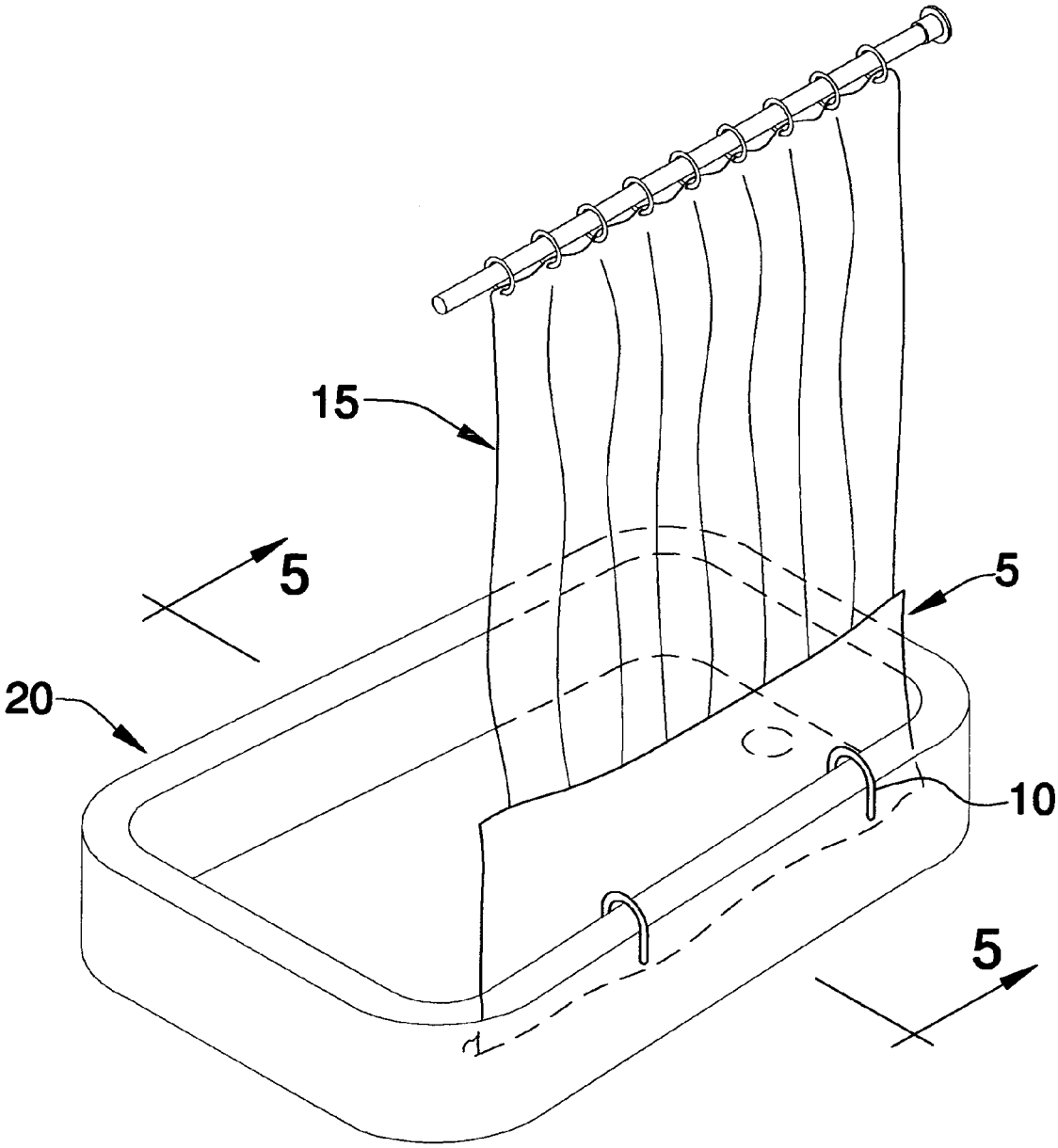
FIG. 1 is a perspective view of the device in use in conjunction with a bathtub.
Figure 2:
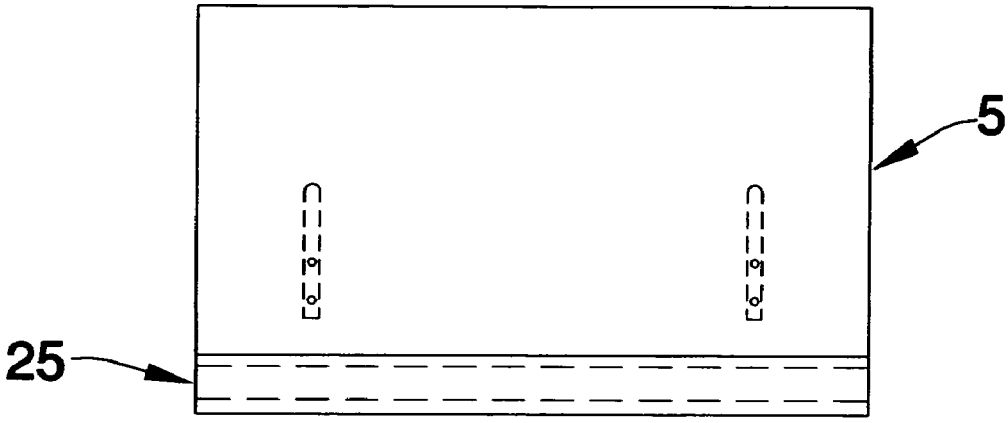
FIG. 2 is a front view of the device.
Figure 3:
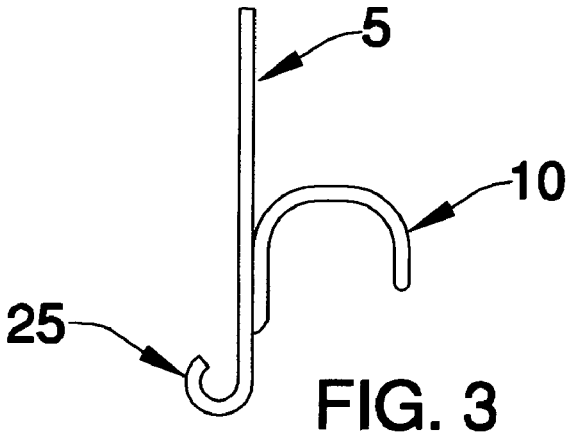
FIG. 3 is a side view of the hook mechanism of the device.
Figure 4:
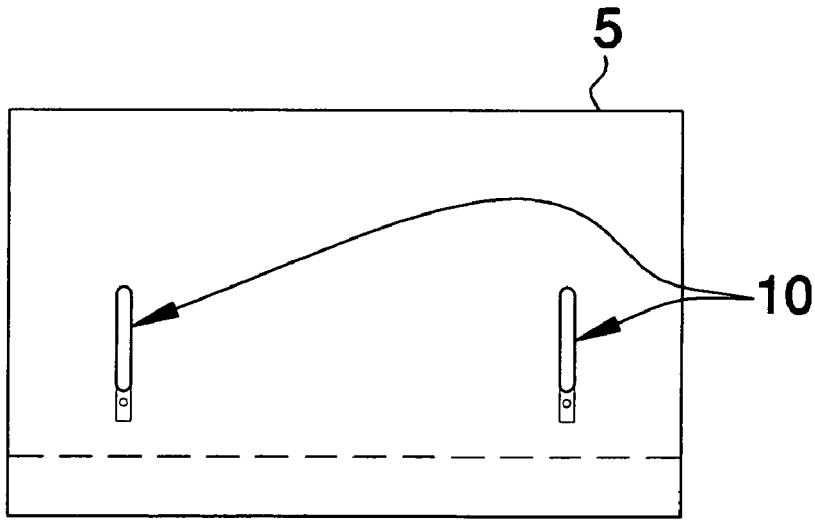
FIG. 4 is a back view of the device.
Figure 5:
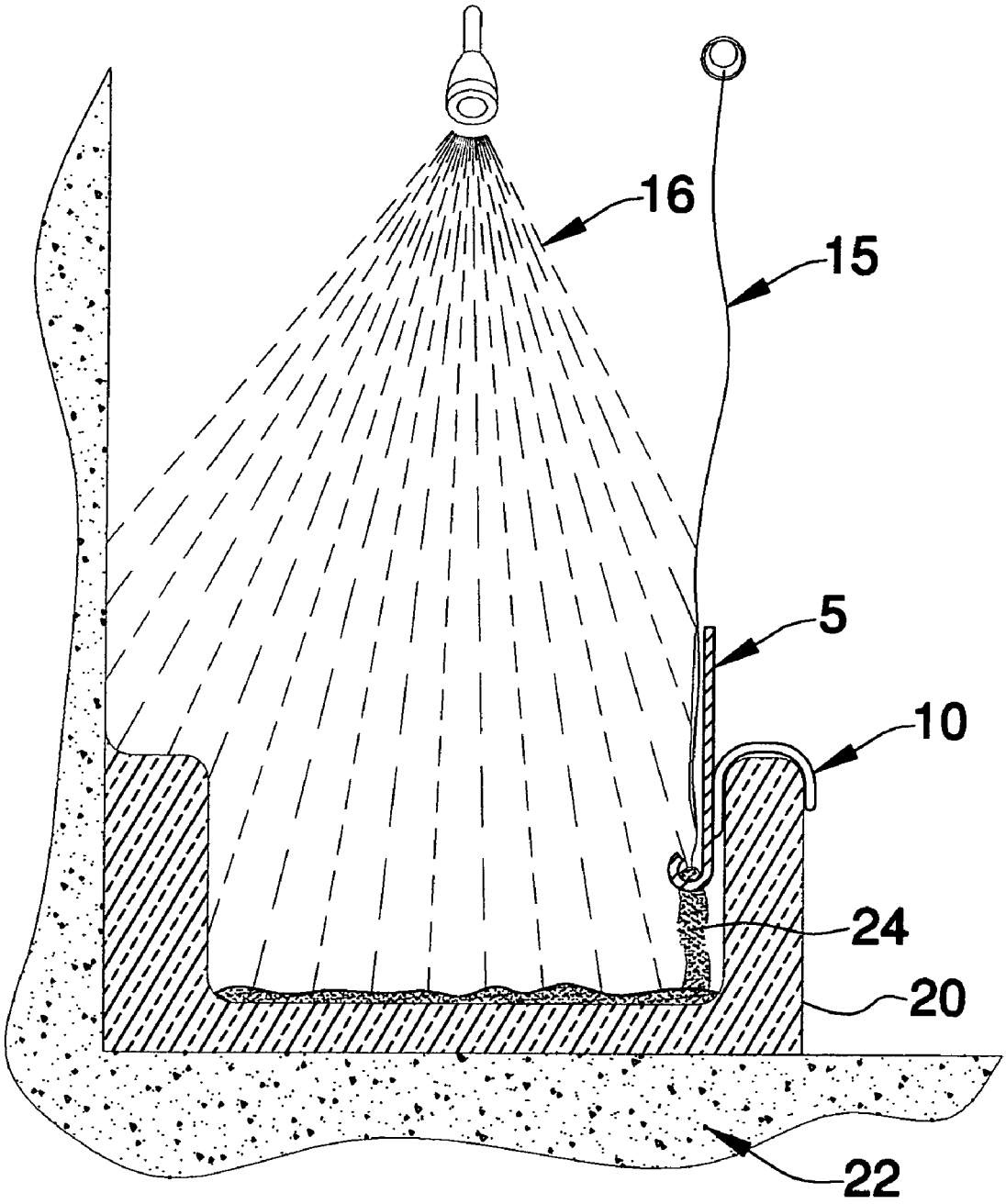
FIG. 5 is a cross-sectional view of the device in use as taken along line 5 in FIG. 1.

The device consists of a rigid or semi-rigid plastic shower guard or shield 5 that will be in a vertical state when in use. The inventor considers a height of between 10 and 14 inches to be sufficient. A pair of rigid hooks 10 will be connected to the back of the shield 5 and will be of sufficient dimension to rest over the top lip of a bathtub 20. FIG. 1, 3, 5 It is anticipated that two hooks will secure the device to the bathtub. FIG. 2, 4 The bottom of the shield 5 will curl toward the inside of the bathtub 20 to form a channel 25 to direct the water back into the tub. The channel 25 will be positioned so as to rest at the approximate midpoint on the inside edge of the bathtub 20. FIG. 5

In use, the device will be positioned so as to rest the hooks 10 over the top edge of a bathtub 20 and have the guard 5 rest vertically outside of and substantially parallel to a shower curtain 15. The shower guard 5 will provide this needed rigidity to maintain the proper position of the shower curtain in the shower area. The channel 25 at the bottom of the guard 5 will be positioned below the bottom edge of the shower curtain 15. Any water 16 from the shower, which manages to get past the shower curtain 15 will be directed by the shield 5 towards the channel 25. Once in the channel, the water 24 will exit the channel 25 in the direction of the bathtub drain.

This will prevent or greatly reduce the amount of water that may exit a shower by insuring that the shower curtain remains somewhat flat during the shower process. The shield can be rigid or semi-rigid but needs to maintain a substantially vertical position when it is installed. Additionally because of the exposure to water it should be constructed of non-corrosive material; hard plastic is probably an excellent choice of material for durability reasons and to provide the needed rigidity.

The invention claimed is:

1. A device for preventing water from exiting a bathtub or shower that possesses a lip, said device comprising:

a shield;

wherein said shield has a front and back side;

wherein said shield has a top edge and a bottom edge;

wherein the shield is affixed to the top edge of a bathtub;

said bottom edge of the shield is substantially curled upward toward the front side of the shield in the shape of an open channel which will direct any water therein, into the tub or shower;

a pair of substantially rigid mounting hooks;

wherein said hooks are mounted onto the back side of said shield;

wherein said hooks have dimensions sufficient to be inserted over the lip of a bathtub so as to position said channel in the tub, on or near an inside surface of the lip.

2. The device as described in claim 1 wherein the dimensions allow the device, when in use, to rest the hooks on the lip of a bathtub and the channel below the bottom edge of a shower curtain.

3. The shield as described in claim 1 is rigid.

4. The shield as described in claim 1 is semi-rigid.

* * * * *